US006742301B1

(12) United States Patent
Schwarz

(10) Patent No.: US 6,742,301 B1
(45) Date of Patent: Jun. 1, 2004

(54) REVOLVING DOOR WITH METAL DETECTION SECURITY

(75) Inventor: Milan Schwarz, La Verne, CA (US)

(73) Assignee: Tomsed Corporation, Lillington, NC (US)

( * ) Notice: Subject to any disclaimer, the term of this patent is extended or adjusted under 35 U.S.C. 154(b) by 0 days.

(21) Appl. No.: 09/946,867

(22) Filed: Sep. 5, 2001

Related U.S. Application Data

(60) Provisional application No. 60/230,141, filed on Sep. 5, 2000.

(51) Int. Cl.[7] ..... E05D 15/02
(52) U.S. Cl. ..... 49/42
(58) Field of Search ..... 49/42, 43, 44; 106/6, 7, 8, 12, 13, 67, 68

(56) References Cited

U.S. PATENT DOCUMENTS 4,060,039 A * 11/1977 Lagarrigue ..... 109/3
4,308,803 A * 1/1982 Pretini ..... 109/3
4,586,441 A * 5/1986 Zekich ..... 109/8
RE33,407 E 10/1990 Schwarz ..... 49/42
5,542,211 A * 8/1996 Colombo ..... 49/42
5,878,529 A * 3/1999 Huber ..... 49/68
6,061,960 A * 5/2000 Korai ..... 49/42

* cited by examiner

*Primary Examiner*—Jerry Redman
(74) *Attorney, Agent, or Firm*—Law Offices of David L. Hoffman

(57) ABSTRACT

A revolving door has a metal detection function. A metal detector will detect a predetermined sufficient amount of metal. The door will not allow a user with such a sufficient amount of metal to pass through. One also cannot pass a gun or other metal object through the revolving door. The door itself is modified by having its metal glass wing holding supports extend only for a portion of the radius of the door wing. In another embodiment, a security revolving door is combined with metal detection security.

6 Claims, 4 Drawing Sheets

REVOLVING DOOR WITH METAL DETECTION SECURITY

CROSS-REFERENCE TO RELATED APPLICATION

The present application is related to U.S. provisional patent application serial No. 60/230141, filed Sep. 5, 2000, priority of which is claimed.

BACKGROUND OF THE INVENTION

The present invention relates to security revolving doors, and in particular, a revolving door with metal detection security which may also have additional security. Security revolving doors are known. For example, in U.S. Pat. No. RE 33,407, issued to the present inventor, a revolving door has security triggered by a mat which detects tailgating (an unauthorized person entering the revolving door in a compartment other than the one entered by an authorized person), piggybacking (two persons in the same compartment), and pass back (an authorized user passing his/her card back to an unauthorized user).

The present inventor also holds U.S. Pat. Nos. 5,012,455 and 5,097,454 using ultrasonic sensors to perform anti-pass back and anti-tailgating functions, and U.S. Pat. No. 5,201,906 for ultrasonic sensors for security doors with anti-pass back, anti-tailgating and anti-piggybacking.

Metal detectors are also known. When they are used in a building having a revolving door, the metal detector is set up at a separate station where there is a guard. This is typically encountered in a courthouse or other government, building.

What is needed, is a metal detector in combination with a revolving door where the revolving door can perform the security function in response to metal detection, yet the door may still function and not itself be detected by the metal detector.

SUMMARY OF THE INVENTION

In one embodiment, the present invention provides a revolving door with a detection function. A metal detector will detect a predetermined sufficient amount of metal. The door will not allow a user with such a sufficient amount of metal to pass through. One also cannot pass a gun or other metal object through the revolving door. The door itself is modified by having its metal glass wing holding supports extend only for a portion of the radius of the door wing.

In another embodiment, a security revolving door such as in the aforementioned U.S. patents is combined with metal detection security.

In a further embodiment, the door may be made with the metal detector adjacent the door by modifying the door to eliminate metal on the portion of the door wings that will pass through the detector and any other metal on the door that may be a problem for the detector, or the metal detector may be spaced from the door by a pair of walls or enclosure so that the door structure need not be modified and to ensure that a user cannot slip between the detector and the door.

DETAILED DESCRIPTION OF THE PREFERRED EMBODIMENTS

Figure 1:
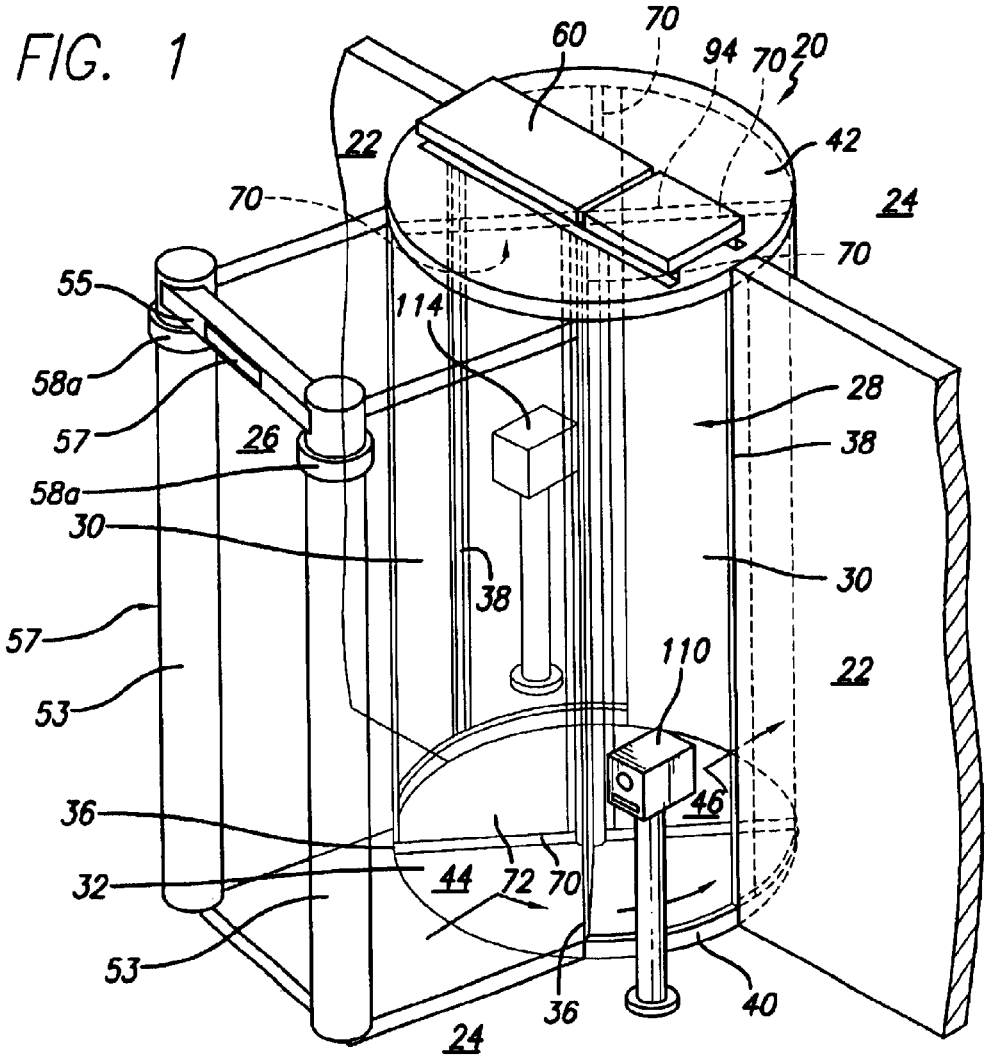
FIG. 1 is a partial schematic view of a four-win revolving combined with a metal detection system in accordance with the invention, wherein a metal detection unit is spaced from the door by an enclosure.

FIG. 1 shows a security door 20 with sensors and a control system according to the present invention. Preferably, the security door 20 is a revolving type. The door is incorporated into a wall 22 which separates a security area 24 from a general access or lesser security area 26. The wall 22 with the door 20 functions as a security barrier between areas 24 and 26.

Figure 2:
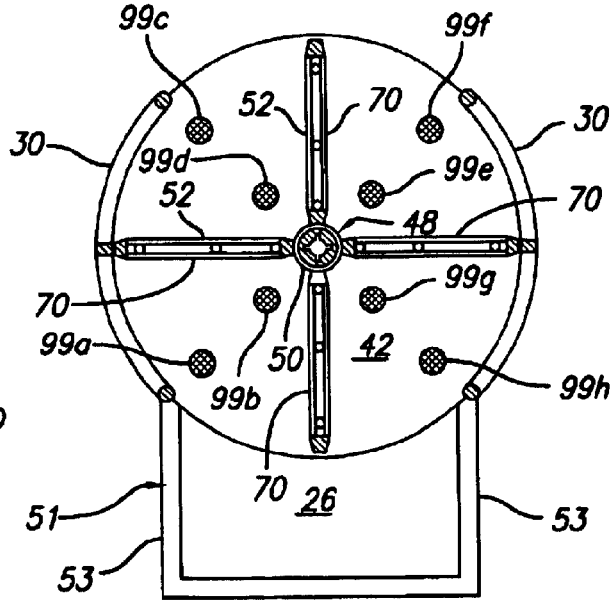
FIG. 2 is a view of the door of FIG. 1 in a schematic sectional view showing the door in a ready position for entry and detection.

The door has a cylindrical housing 28 which includes upstanding, semi-cylindrical panels 30. The panels 30, as shown in FIGS. 1 and 2, extend between a circular bottom 32 and a top 42. The panels in this four-panel embodiment span approximately 90 degrees of arc. Each panel 30 is fashioned from a pair of semi-cylindrical segments (such as glass) connected between and supported by edge posts 36, a center post 38, and a bottom skirt 40 secured to the bottom 32. The posts 38 are connected to the wall 22 to incorporate the panels 30 into the wall structure. The semicylindrical segments may be fashioned from various materials including standard or safety glass, bullet-proof glass, acrylic or solid bars as desired, but preferably sufficiently solid to prevent slipping a gun or knife through.

The top 42 is typically disposed in or incorporated into the ceiling (not shown) of the facility. The panels 30, top 42, and bottom 32 cooperate to define cylindrical housing 28 having two arcuate portals, an entrance 44 in general access area 26 and an exit 46 in security area 24.

To prevent unauthorized persons from passing from entrance 44 through housing 28 to exit 46, door 20 includes a revolving door member 48 disposed in the housing (see FIG. 2). Revolving door member 48 has a rotatable shaft 50 supported between the top 42 and bottom 32 centered along the axis of revolution of the door. The top 42 has an axial opening (not shown) through which shaft 50 protrudes. Four wings 52 project outwardly from shaft 50 and are of sufficient length to sweep close to semi-cylindrical panels 30 While door 20 preferably has four identical panels or wings 52 spaced roughly 90 degrees from one another, more or fewer panels could be used as desired. The four spaced panels 52 cooperate with housing 28 to define four rotatable pie-slice-shaped compartments. A person desiring to move from one of the areas 24,26 to the other enters a selected compartment and travels therewith between entrance 44 and exit 46.

Door 20 includes a drive system 60 which comprises an electric motor, a motor multiplier and a gear reducer such as described in U.S. Pat. No. 4,627,193, hereby incorporated by reference. Drive system 60 is coupled to revolving door member 48 so that operation of the drive system rotates member 48.

The door wings 52 each include a rectangular frame 70 supporting a pane 72. The frame 70 has a length to project from the shaft 50 to part way to the semicylindrical panels 30 as the member 48 revolves, so that if the frame is metal, it will not be detected by metal detector assembly 51. The frame has a height to extend from a location near the bottom 32 to a position near the top 42. Accordingly, the wings 52, in cooperation with the housing 28, define the compartments.

The wings 52 can be formed many different ways. For example, the wings need not be solid panes, but can be formed by bars, grating or the like.

To prevent unauthorized ingress and egress from security area 24, a control system is provided to perform the appropriate regulation. In the disclosed embodiment, the control system according to the invention is located in a box 94 on the top 42 of housing 28. While the following description is (for purposes of explanation) primarily directed toward unauthorized entry into security area 24, the description is equally applicable to the situation wherein unauthorized items including personnel attempt to exit the security area.

Figure 3:
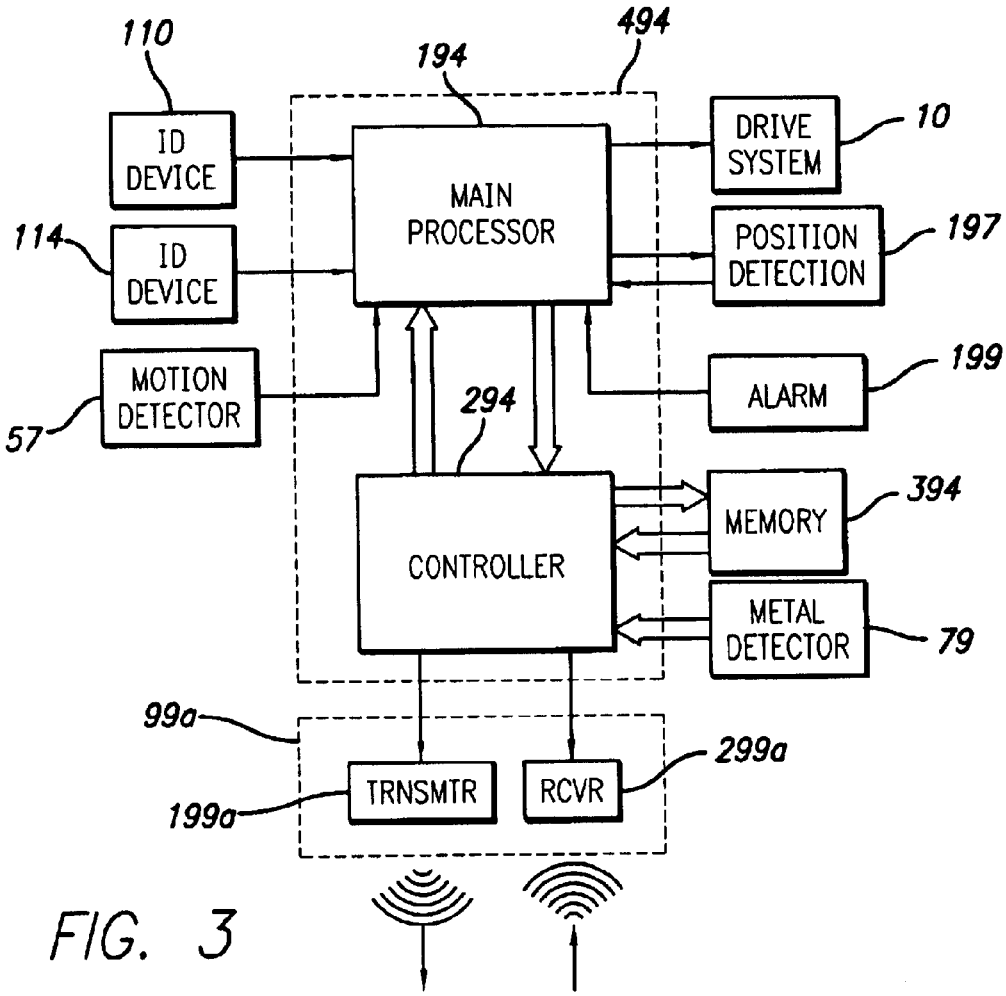
FIG. 3 is a control system schematic for the door of FIG. 1.

As shown in FIG. 3, the control system includes a main processor 194, a controller 294 and supporting peripheral hardware housed within enclosure 94 for controlling the starting, stopping and directional rotation of the motor and shaft which turn the compartments. As a specific example of the preferred embodiment the main processor Is an Intel 8749 or 8751 microprocessor manufactured by Intel Corporation and the controller is a Zilog Z8 microprocessor manufactured by Zilog Corporation. The peripheral hardware includes a memory 394 sufficiently large to perform calculations and control functions which will hereinafter become apparent, for example, a random-access memory (RAM). Suitable types and sizes of memory will be evident to one of ordinary skill and will depend upon the desired speed and accuracy of the detection system and the various memory management techniques adopted.

The main processor 194 includes or is linked to a mechanism which determines door position, e.g. by using a pulse generator as set forth in U.S. Pat. No. 4,627,193. In that patent, door position is tracked by using a cam and a cam follower, which has its motion translated by a proximity sensor into pulses which occur at each predetermined increment of door rotation, e.g., 3 degrees. This mechanism is represented in FIG. 3 herein by position detection system 197. The pulses are recorded by a counter, which is read by the main processor 194. The value on the counter corresponds to a specific amount of door rotation. When the door completes 180 degrees of rotation, i.e., the point in the present embodiment where the entered compartment has moved to the exit compartment, another proximity detector in the position detection system 197 indicates such movement to the main processor 194, and the processor stops drive system 60 and resets the counter.

In a more preferred embodiment, the position detection system 197 may consist of an encoder disk, which is basically a plate, preferably circular, fixed to the main shaft 50 so as to turn with it. The encoder disk has a series of holes positioned circumferentially around it in a known relationship to the door wings. For example, there may be 120 holes spaced at three degrees from each other. There is also a sensing system, such as a light emitting diode on one side of the encoder disk and a detector on the opposite side of the disk, aligned with the diode. The detector is connected to the processor, so that the processor can track each three degrees of door rotation and determine where the door wings are in relation to various land marks, such as a quarter rotation point (for a four wing door), a midpoint or sixty degree rotation point (for a three wing door), etc., as is well known in the art.

The control system also includes identification devices 110, 114 such as card readers or other means for identifying an authorized user to initiate the entry sequence and anti-jam features as set forth in that same patent.

In the present invention to detect people or objects, the door includes an array of sensors 99*a*–99*h*, preferably arranged in a circular pattern around the ceiling of the housing as depicted in FIG. 2. It is preferred to mount the sensors on the ceiling rather than the floor where they may be stepped on or subjected to rain, water, snow, dirt or other undesirable environmental conditions. Nevertheless, with appropriate environmental protection, the sensors are also mountable on the floor.

Transmitters (e.g., 199*a* in sensor 99*a*) in the sensors radiate energy waves, preferably ultrasonic, in a generally conical shape and receivers (e.g., 299*a* in sensor 99*a*) detect the echoes of the waves reflected from any physical surfaces encountered. Having multiple concentric arrays of the sensors around center post-axis 24 allows greater coverage of the area in the compartment. Preferably, each circle includes at least one sensor for each compartment, each sensor being placed at an angular displacement about the center post-axis identical to that of the angle defined by any two adjacent door panels 52. In the illustrated revolving door, adjacent panels meet at 90 degrees so that the sensors are separated by 90 degrees. Although this geometry is preferred, there are many other configurations and numbers of sensors which will provide suitable coverage of the housing and which fall within the spirit and scope of the invention. Security revolving doors are known. For example, in U.S. Pat. Nos. 5,012,455 and 5,097,454, incorporated by reference herein, ultrasonic sensors are used to perform anti-pass back and anti-tailgating functions,and in U.S. Pat. No. 5,201,906, also incorporated herein by reference, ultrasonic sensors are used for security doors to provide anti-pass back, anti-tailgating and anti-piggybacking.

In general, operation takes place as follows: a user is detected by motion detector 57, or in the case of higher security, an authorized user has been identified by the card reader 11O or 114, the main processor 194 activates the position detection system 197 and also activates drive system 60 to revolve the compartments. At the same time or substantially contemporaneously, the main processor. 194 instructs controller 294 to activate the metal detector. It may also activate sensors 99*a*–99*h* to detect non-empty compartments. The sensors emit bursts of ultrasonic waves and detect retune echoes from objects including people. FIG. 3 shows controller 294 in association with memory 394 and sensor 99*a*. Connection with and operation of the other sensors are the same.

The metal detector system 51 has metal detectors incorporated in walls 53 and is located at the entrance in this embodiment. It could equally be located at the exit to detect guns, knives and other large metal masses. A suitable metal detector scanning system is sold by CEIA-USA Ltd., Twinsburg, Ohio, such as a HI-PE Elliptic™ metal detector. Where the de detector is incorporated in the walls 53, the walls provide a way to space the detector from the door to avoid interference by metal on the door wing, such as a frame or electromagnet (for the electromagnetic door release system in the event of a fire or other emergency). In addition, the walls may be needed to prevent any users from slipping in a space between the detector and the revolving door to avoid detection, and to conform the door opening geometry to the detector geometry. The walls would imply be built around or incorporate the metal detector of FIG. 5 or like metal detector, or the metal detector would be placed at the end of the walls, as shown in FIG. 1. In any of the embodiments, it is preferable to attach the detector to the walls 53 or the revolving door, e.g., by brackets 58*a* and bolts, double sided tape, or other mechanisms to secure the detector to the door. Alternatively or additionally, a mechanism to detect physical movement of the detector may be employed.

Figure 5:
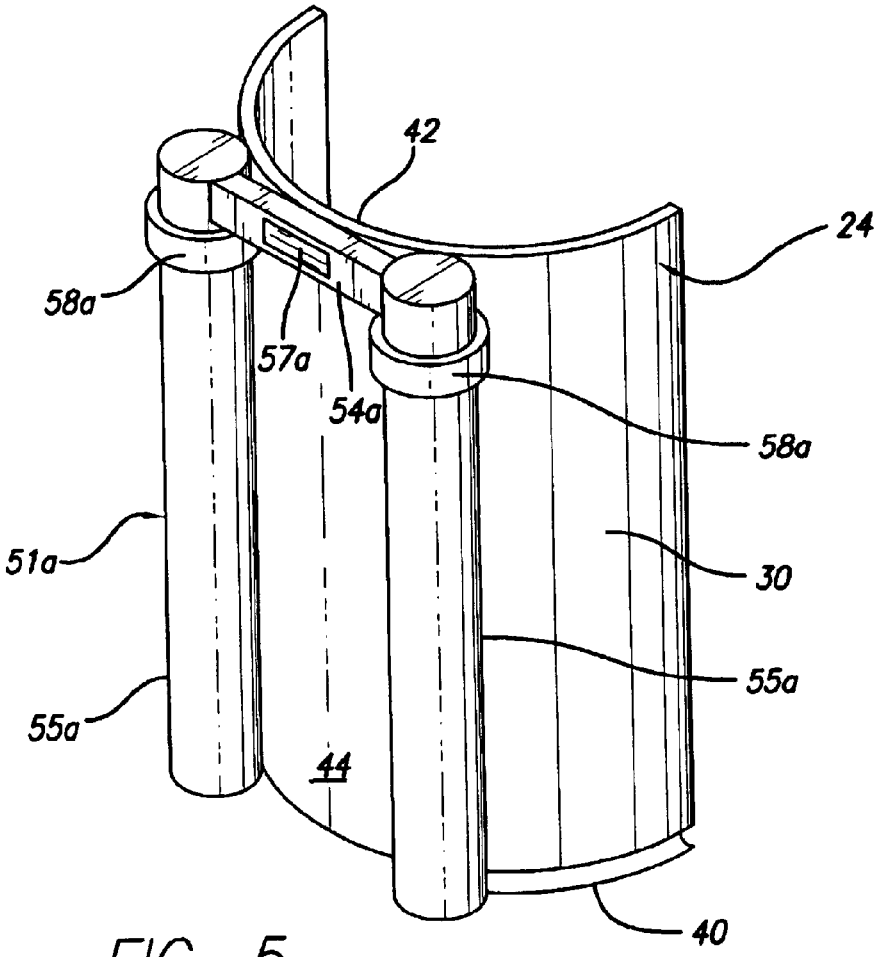
FIG. 5 is a modification of FIG. 1 showing a metal detection unit of the metal detection system adjacent the door and without an enclosure.
Figure 6:
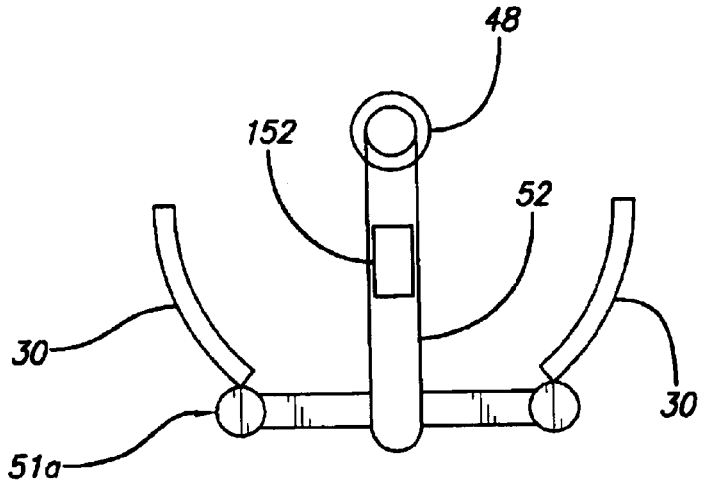
FIG. 6 is a view of the door of FIG. 5 similar to that of FIG. 2, i.e., a schematic sectional view showing the door in a ready position for entry and detection.
Figure 7:
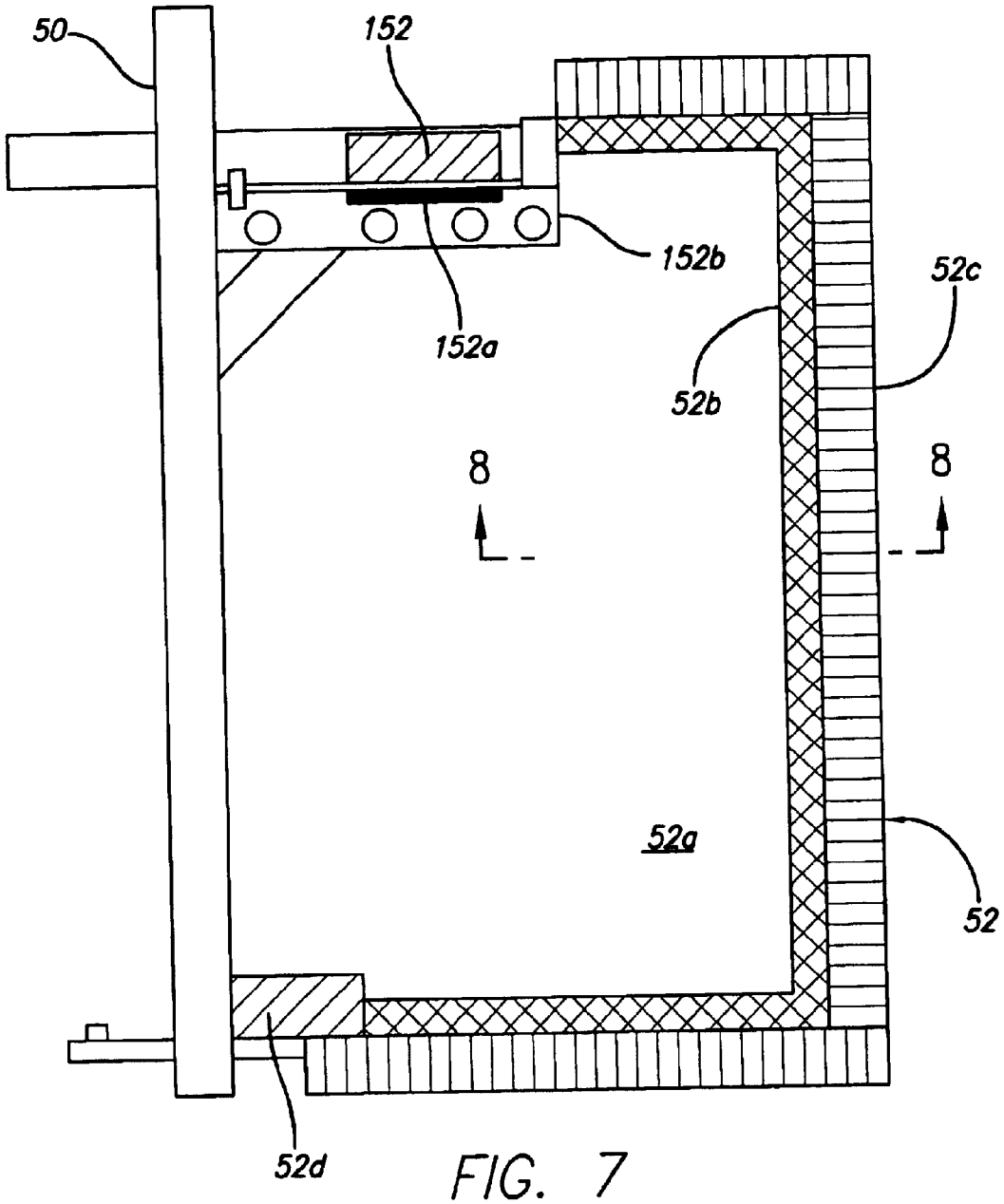
FIG. 7 is an enlarged partial sectional view of a door wing suitable for use with the revolving door of the invention.
Figure 8:
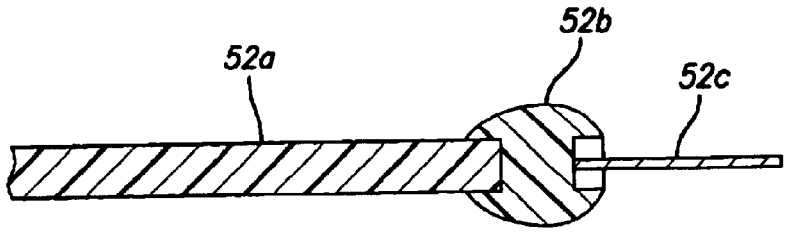
FIG. 8 is an enlarged sectional view of the door wing of FIG. 7 taken along a line 8—8.

FIGS. 7 and 8 show how the door wings 52 may be constructed, particularly for the embodiment of FIG. 5 where a portion of the wing will pass through the metal detector (see, e.g., FIG. 6). A door frame 52*b* is plastic for holding glass 52*a*. Around the outer edge of the plastic, for a substantial portion, there is a felt runner 52*c*. The electromagnet 152 for the door safety release mechanism is located on a door holding bracket or arm 50*a* fixed to the shaft. The magnet is substantially inside the remote radial end of the wing, e.g., half or less than half the way from the shaft 50. A metal extrusion 152*b* is attached to the glass to hold a magnetic strike plate 152*a* for the electromagnet. The door frame is supported by a pivot 52*d* on the bottom.

FIGS. 5 and 6 show a version of the door where a metal detector 51*a* is positioned adjacent the door. In this embodiment, the detector 51*a* has two sides 55*a*, e.g., having elliptical sections, and overhead member 54*a* which may be positioned just below the top 42 of the door and may have a microwave sensor 57*a*. The door sides 55*a* are adjacent the panels 30 of the revolving door 24.

Figure 4:
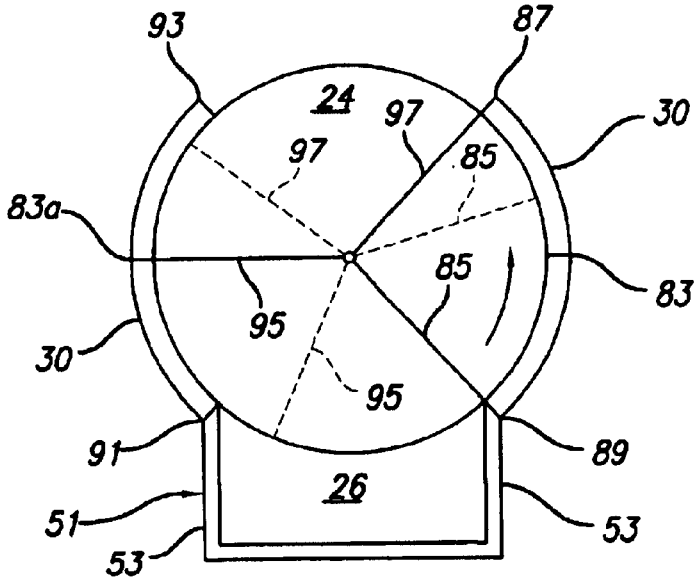
FIG. 4 is a view similar to FIG. 2 showing the door with three wings instead of four.

The door may have three or four wings. First, metal detector structure and operation will be described below with respect to a three-wing door (FIG. 4), where the wings are typically 120° apart and the curved side panels are such that they extend for the full length of the arc between door panels. The door may also be a security revolving door. A satisfactory revolving door is manufactured by Safesec Corporation, also known as Revolving Door Control, Inc., located in Ontario, Calif. The three-wing door provides for a fairly large opening for entrance and exit, typically used at airports where users often have luggage.

In normal operation, the door may be set with a passive motion detector, e.g., a microwave detection system 57 mounted on a top member 55 to detect when;a user is approaching. When it detects a person and the control system recognizes that detection, the door begins revolving, e.g., counterclockwise. The person passes through the metal detector. If there is no metal or insufficient metal to set off the detector, the door will continue to operate in normal mode allowing passage. Instead of a microwave detector, other means to detect people entering the door, such as mats, may be used. In addition, a card reader or button or other mechanism requiring the user to do something, or the user to be authorized, is possible. A push start may also be used.

The door will continue revolving and allow the normal user to pass through to the other side. It then will stop revolving.

In the situation where the user has a gun, referred to herein as a gunholder, the door starts rotating in response to motion detection, e.g., microwave detection of the gunholder. The gunholder then enters the door. The metal detector senses the gun and signals the controller, which then stops the door from rotating until two conditions are met: the gun passes back through the metal detector and the gunholder exits back the way he or she came. If the leading wing 85 of the door has not yet passed the midpoint, i.e., point 83 (for a three wing door), the door preferably will also back up automatically to force the gunholder out, e.g., by returning the leading wing 85 to the initial point 89.

If the door has passed the midpoint, it will only back up so that the leading wing reaches the midpoint. This is because before the leading wing gets back to the midpoint, the trailing wing 95 of the door leaves the compartment it defines with the third wing 97 of the door accessible to, for example, the gunholder's accomplice who could sneak into that compartment when trailing wing 95 passes point 91 in the forward mode, and when the door backs up, if the door continued to back up, the accomplice could gain access to the other side when third wing 97 passes point 93 when the door reverses. In this situation, someone foolish enough to sneak into that compartment will be trapped until the gunholder exits and some security personnel arrive, because wings 95, 97 could stop at points 91, 93 respectively. Rather than have the possibility of trapping someone, the door could have a trapped man detector which would then initiate slight forward rotation to let the trapped person out, as is known in the art. Also, the door need not reverse all the way to the midpoint, which would eliminate the possibility of trapped users. Further, the door opening geometry in relation to the wings could be such that there would be no trapped user.

Another scenario is where a gunholder approaches and instead of passing through the metal detector, slides or tosses the gun through. The detector preferably is one which can detect the gun under these circumstances. The door will stop rotating and freeze until the gun is removed. If the door has gone past the midpoint, the door will rotate back to the midpoint. The door would also stop rotating because it does not detect a person entering and passing through. However, even if the gunholder now enters the door, the aforementioned stoppage of the door in response to the gun detection prevents the gunholder's passage. The situation will be the same as in the scenario where the gunholder enters the door with the gun.

In any mode where a violation takes place, the door could rotate to the point where wings 85 and 95 reach end point and initial points 87 and 89, respectively, and stop, thereby trapping the gunholder. In the four wing door, this is readily achieved. It can also be optionally done in the three wing door. In this situation, it is preferred to monitor the door.

In the next scenario, where the door is a one-way passage security door, even if a normal user enters the door, if someone is trying to pass from the other direction, he will be detected by overhead sensors or other means and the controller will stop the door. Preferably, it will back out the person trying to pass in the opposite direction from exit 24 to entrance 26.

In the situation where the door is two-way and a normal user is exiting through the door from exit 24 to entrance 26 and then a gunholder slides into the door from the opposite direction at entrance 26, the door will stop before the quarter point 83 if the quarter point has not been passed and will back the gunholder out. This will also back out the normal user. If the door has passed the quarter point, it will back up to the quarter point and may trap the normal user.

It is also possible to add a mode where an authorized gunholder (such as a security guard or police officer) will pass through the door. This may be done by means of card reader 94 or 114. The authorized gunholder swipes a card and then the door stoppage in response to gun detection is temporarily disabled, e.g., for one hundred twenty degrees of door rotation. Other security revolving door features may be included such as an emergency mode where an electromagnetic brake releases the wings.

The revolving door may be a security revolving door such as made by Safesec Corporation and/or as disclosed in U.S. Pat. Nos. 5,012,455 and 5,097,454, using ultrasonic sensors to perform anti-passback and anti-tailgating functions, and U.S. Pat. No. 5,201,901 using ultrasonic sensors, such as in the aforementioned two patents, with anti-piggybacking, each of the three U.S. patents being incorporated by reference herein.

Ideally, the metal detector is passive until motion detection, which is also passive to minimize energy use. Operation of the four-wing embodiment is similar to the three-wing embodiment.

The door may also operate as follows, e.g., for a three wing door. A four wing door will operate similarly, but using the quarter point as a reference instead of the midpoint. If the door processor receives a violation signal from the metal detector, the door stops. If the leading wing is before the midpoint, the door reverses to the original starting position. If the leading wing is past the midpoint, the door reverses to the midpoint.

The detected violator must exit the way he/she came in, along with the gun (metal). Note that after the door completes reversing to the appropriate point, it locks in position until the person and metal are gone, i.e., exited back past the metal detector.

If the detected violator exits without the metal, then the door remains locked in position with alarm ringing until the metal is gone too. If the detected violator passes the metal back to the entry area but he/she remains in the door, then the door remains in the locked position with the alarm going. After both the violator and metal pass back through the metal detector, the door and alarm are reset to their initial ready state awaiting the next user.

While the present invention has been described with regards to particular embodiments, it is recognized that additional variations of the present invention may be devised without departing from the inventive concept.

What is claimed is:

1. A control system and a security door of a type having a housing with a first portal and a second portal, a door member rotatably disposed in the housing and having a plurality of door wings which, in cooperation with the housing, define a plurality of compartments moveable between the first and second portals in response to rotation of the door member, the control system comprising:

a metal detector disposed proximate the first portal for issuing a metal detection output when a metal is detected;

means for rotating the door member to move a selected compartment from one of the first and second portals to the other of the first and second portals;

controller means, connected to the metal detector and the means for rotating, for stopping the means for rotating in response to the metal detection output from the metal detector, wherein the door wings of the door member each comprise a panel and a frame for holding the panel, and the frame consists essentially of a nonmetallic material at a radial outer portion including a vertical portion and horizontal portions of the frame extending above and below the panel thereof, whereby the frame will not be detected by the metal detector when the door wings pass by the metal detector.

2. The system of claim 1 wherein one side of the metal detector is accessible without passing through a security door.

3. The system of claim 1 wherein the panel consists essentially of a nonmetallic material.

4. The system of claim 1 wherein the frame consists of a nonmetallic material.

5. A control system for a security revolving door of a type having a housing with a first portal and a second portal, a door member rotatably disposed in the housing and having a plurality of door wings which, in cooperation with the housing, define a plurality of compartments moveable between the first and second portals in response to rotation of the door member, the control system comprising:

a metal detector disposed proximate the first portal for issuing a metal detection output when a metal is detected;

means for rotating the door member to move a selected compartment from one of the first and second portals to the other of the first and second portals;

controller means, connected to the metal detector and the means for rotating, for stopping the means for rotating in response to the metal detection output from the metal detector, wherein the door wings of the security revolving door consist essentially of a nonmetallic material at a radial outer portion thereof, whereby the door wings will not be detected by the metal detector, wherein a radially outer portion of the door wings pass through the metal detector, and at least the radially outer portion consists essentially of a nonmetallic material.

6. A control system for a security revolving door of a type having a housing with a first portal and a second portal, a door member rotatably disposed in the housing and having a plurality of door wings which, in cooperation with the housing, define a plurality of compartments moveable between the first and second portals in response to rotation of the door member, the control system comprising:

a metal detector disposed proximate the first portal for issuing a metal detection output when a metal is detected;

means for rotating the door member to move a selected compartment from one of the first and second portals to the other of the first and second portals;

to controller means, connected to the metal detector and the means for rotating, for stopping the means for rotating in response to the metal detection output from the metal detector, wherein the door wings of the security revolving door consist essentially of a nonmetallic material at a radial outer portion thereof, whereby the door wings will not be detected by the metal detector, wherein the door wings have an electromagnet, and the electromagnet is located at a position on the door wings inside a radial midpoint of the door wings.

* * * * *